US008911684B2

(12) United States Patent
Augstein et al.

(10) Patent No.: US 8,911,684 B2
(45) Date of Patent: Dec. 16, 2014

(54) MICROFLUIDIC ELEMENT FOR ANALYZING A LIQUID SAMPLE

(75) Inventors: Manfred Augstein, Mannheim (DE); Christoph Boehm, Viernheim (DE); Carlo Effenhauser, Weinheim (DE); Rijk Edwin Oosterbroek, Cham (CH); Susanne Wuerl, Mannheim (DE)

(73) Assignee: Roche Diagnostics Operations, Inc., Indianapolis, IN (US)

( * ) Notice: Subject to any disclaimer, the term of this patent is extended or adjusted under 35 U.S.C. 154(b) by 0 days.

(21) Appl. No.: 13/487,707

(22) Filed: Jun. 4, 2012

(65) Prior Publication Data

US 2012/0301371 A1 Nov. 29, 2012

Related U.S. Application Data

(63) Continuation of application No. PCT/EP2010/068499, filed on Nov. 30, 2010.

(30) Foreign Application Priority Data

Dec. 4, 2009 (EP) ..... 09015031

(51) Int. Cl.

| | |
|---|---|
| ***B01L 99/00*** | (2010.01) |
| ***B01F 11/00*** | (2006.01) |
| ***B01F 1/00*** | (2006.01) |
| ***B01F 13/00*** | (2006.01) |
| ***B01L 3/00*** | (2006.01) |
| ***B01F 15/02*** | (2006.01) |
| ***B01F 9/00*** | (2006.01) |

(52) U.S. Cl.

CPC ..... *B01F 1/0027* (2013.01); *B01F 11/0002* (2013.01); *B01F 13/0059* (2013.01); *B01L 2200/16* (2013.01); *B01L 3/502746* (2013.01); *B01F 15/0233* (2013.01); *B01F 9/0014* (2013.01); *B01L 2400/0409* (2013.01); *B01F 15/0203* (2013.01); *B01L 2400/086* (2013.01)

USPC ..... 422/506; 422/50; 422/500; 422/501; 422/502; 422/504

(58) Field of Classification Search

USPC ..... 422/50, 63, 64, 68.1, 72, 500–507

See application file for complete search history.

(56) References Cited

U.S. PATENT DOCUMENTS

| | | | |
|---|---|---|---|
| 4,456,581 | A | 6/1984 | Edelmann et al. |
| 4,580,896 | A | 4/1986 | Brickus et al. |

(Continued)

FOREIGN PATENT DOCUMENTS

| | | | |
|---|---|---|---|
| DE | 102005016509 | A1 | 10/2006 |
| EP | 1077771 | B1 | 2/2001 |

(Continued)

OTHER PUBLICATIONS

International Search Report issued Feb. 23, 2011 in Application No. PCT/EP2010/068499, 3 pages.

(Continued)

*Primary Examiner* — Paul Hyun
*Assistant Examiner* — Robert Eom
(74) *Attorney, Agent, or Firm* — Dinsmore & Shohl LLP

(57) ABSTRACT

A microfluidic element for analyzing a bodily fluid sample for an analyte contained therein is provided, the element having a substrate, a channel structure that is enclosed by the substrate, and a cover layer, and is rotatable around a rotational axis. The channel structure of the microfluidic element includes a feed channel having a feed opening, a ventilation channel having a ventilation opening, and at least two reagent chambers. The reagent chambers are connected to one another via two connection channels in such a manner that a fluid exchange is possible between the reagent chambers, one of the reagent chambers having an inlet opening, which has a fluid connection to the feed channel, so that a liquid sample can flow into the rotational-axis-distal reagent chamber. At least one of the reagent chambers contains a reagent, which reacts with the liquid sample.

15 Claims, 9 Drawing Sheets

(56) References Cited

U.S. PATENT DOCUMENTS

| | | | | |
|---|---|---|---|---|
| 2005/0041525 | A1 | 2/2005 | Pugia et al. | |
| 2008/0292502 | A1 | 11/2008 | Kitawaki et al. | |
| 2009/0191643 | A1 * | 7/2009 | Boehm et al. | 436/164 |

FOREIGN PATENT DOCUMENTS

| | | | |
|---|---|---|---|
| EP | 1944612 | A1 | 7/2008 |
| WO | 03/103835 | A1 | 12/2003 |

OTHER PUBLICATIONS

Grumann, Markus, "Readout of Diagnostic Assays on a Centifugal Microfluidic Platform," Oct. 2005, Dissertation, University of Freiburg, Germany, 228 pages.

Chang, Chun-Wei et al., "Experimental investigation and characterization of micro resistance welding with an electro-thermal actuator," Journal of Micromechanics and Microengineering, 2009, 8 pp. vol. 19.

* cited by examiner

MICROFLUIDIC ELEMENT FOR ANALYZING A LIQUID SAMPLE

CROSS-REFERENCE TO RELATED APPLICATIONS

This application is a continuation of International Application No. PCT/EP2010/068499, filed 30 Nov. 2010, which claims the benefit of European Patent Application No. 09015031.9, filed 4 Dec. 2009, the disclosures of which are hereby incorporated by reference in their entirety.

TECHNICAL FIELD

The present disclosure relates to diagnostic test devices and, more particularly, to a microfluidic element for analyzing a liquid sample, typically in a bodily fluid sample.

BACKGROUND

Microfluidic elements for analyzing a liquid sample and for blending a liquid with a reagent are used in diagnostic tests (in vitro diagnostics). In these tests, bodily fluid samples are determined for an analyte contained therein for medical purposes. The term blending comprises the possibility that the reagent is provided in liquid form, i.e., that two liquids are mixed with one another. In addition, the term comprises the possibility that the reagent is provided as a solid and is dissolved in a liquid and homogenized. In many applications, the solid dry reagent is introduced in liquid form into the fluidic element and dried in a further step, before the element is used for the analysis.

An important component during the analysis are test carriers, on which microfluidic elements having channel structures for accommodating a liquid sample are provided, to allow the performance of complex and multistep test protocols. A test carrier can comprise one or more fluidic elements.

Test carriers and fluidic elements consist of a carrier material, typically a substrate made of plastic material. Suitable materials are, for example, COC (cyclo-olefin copolymers) or plastics such as PMMA, polycarbonate, or polystyrene. The test carriers have a sample analysis channel, which is enclosed by the substrate and a cover or a cover layer. The sample analysis channel frequently consists of a succession of a plurality of channel sections and interposed chambers, which are expanded in comparison to the channel sections. The structures and dimensions of the sample analysis channel having its chambers and sections are defined by a structuring of plastic parts of the substrate, which is generated by injection-molding technologies or other methods for producing suitable structures, for example. It is also possible to introduce the structure by material-removing methods such as milling.

Fluidic test carriers are used, for example, in immunochemical analyses having a multistep test sequence, in which a separation of bound and free reaction components occurs. A controlled liquid transport is required for this purpose. The control of the process sequence can be performed using internal measures (inside the fluidic element) or using external measures (outside the fluidic element). The control can be based on the application of pressure differences or also the change of forces, for example, resulting from the change of the action direction of gravity. If centrifugal forces occur, which act on a rotating test carrier, a control can be performed by changing the rotational velocity or the rotational direction or through the spacing from the rotational axis.

To perform the analyses, the sample analysis channel of the microfluidic elements contains at least one reagent, which reacts with a liquid introduced into the channel. The liquid and the reagent are mixed with one another in the test carrier so that a reaction of the sample liquid with the reagent results in a change of a measuring variable which is characteristic for the analyte contained in the liquid. The measuring variable is measured on the test carrier itself. Measurement methods which can be optically evaluated and in which a color change or another optically measurable variable is detected, are typical.

For the performance of the analysis, it is decisive that the reagent provided in dried form is dissolved by the sample liquid and is blended therewith. In the prior art, some efforts have been made to improve the blending. For example, in rotating test carriers, which are rotated around a rotational axis in an analysis system, the blending is promoted by rapid changes of the rotational direction. This resulting "shake mode" is described, for example, in a particular embodiment by Markus Grumann, "Readout of Diagnostic Assays on a Centrifugal Microfluidic Platform", (Dissertation University of Freiburg, 2005, URN (NBN): urn:nbn:de:bsz:25-opus-22723).

Further known methods for improving the blending of sample liquid and reagent comprise the introduction of magnetic particles, which are set into motion by the action of an electromagnet or permanent magnet. The outlay during the production of the test carriers rises through the integration of the particles. In addition, the analysis systems must have further components, namely the magnets, and therefore become expensive.

Other methods include, for example, elements whose capillary channels contain particular flow obstructions. The production of such obstructions, for example, ribs, must be implemented in the microstructure and are therefore expensive and make the production process of the test carrier more difficult. In addition, such structures are not suitable for all mixing processes or for all reagents and sample liquids.

In spite of the manifold efforts to improve mixing procedures in microfluidic elements, in particular the blending of dried solid reagents and sample liquids, there is still a demand for a microfluidic element or test carrier, in which the blending of small amounts of sample liquids in particular is improved. Furthermore, the fluidic element is to be capable of simultaneously dissolving different reagents which are introduced separately and are located at different spatial locations, for example, and to cause the sample liquid to react with different reagents.

SUMMARY

It is against the above background that the embodiments of the present disclosure provide certain unobvious advantages and advancements over the prior art. In particular, the inventors have recognized a need for improvements in microfluidic elements for analyzing liquid samples, typically bodily fluid samples.

Although the embodiments of the present disclosure are not limited to specific advantages or functionality, it is noted that the present disclosure provides a test carrier for analyzing a bodily fluid sample for an analyte contained therein without restriction of the generality of a microfluidic element. In addition to bodily fluids, other sample liquids can also be analyzed.

According to one embodiment, a microfluidic element for analyzing a liquid sample is provided comprising a substrate, a channel structure enclosed by the substrate, and a cover layer, wherein the microfluidic element is rotatable around a rotational axis; the channel structure includes a feed channel having a feed opening, a ventilation channel having a ventilation opening, and at least two reagent chambers; the reagent chambers are connected to one another via two connection channels in such a manner that a fluid exchange is possible between the reagent chambers, one of the reagent chambers has an inlet opening, which has a fluid connection to the feed channel, so that a liquid sample can flow into the rotational-axis-distal reagent chamber, which, of the two reagent chambers, is positioned farther away from the rotational axis, and at least one of the reagent chambers contains a reagent, which reacts with the liquid sample.

These and other features and advantages of the embodiments of the present disclosure will be more fully understood from the following detailed description taken together with the accompanying claims. It is noted that the scope of the claims is defined by the recitations therein and not by specific discussion of features and advantages set forth in the present description.

BRIEF DESCRIPTION OF THE DRAWINGS

The following detailed description of the embodiments of the present disclosure can be best understood when read in conjunction with the following drawings, where like structure is indicated with like reference numerals and in which.

Figure 1:
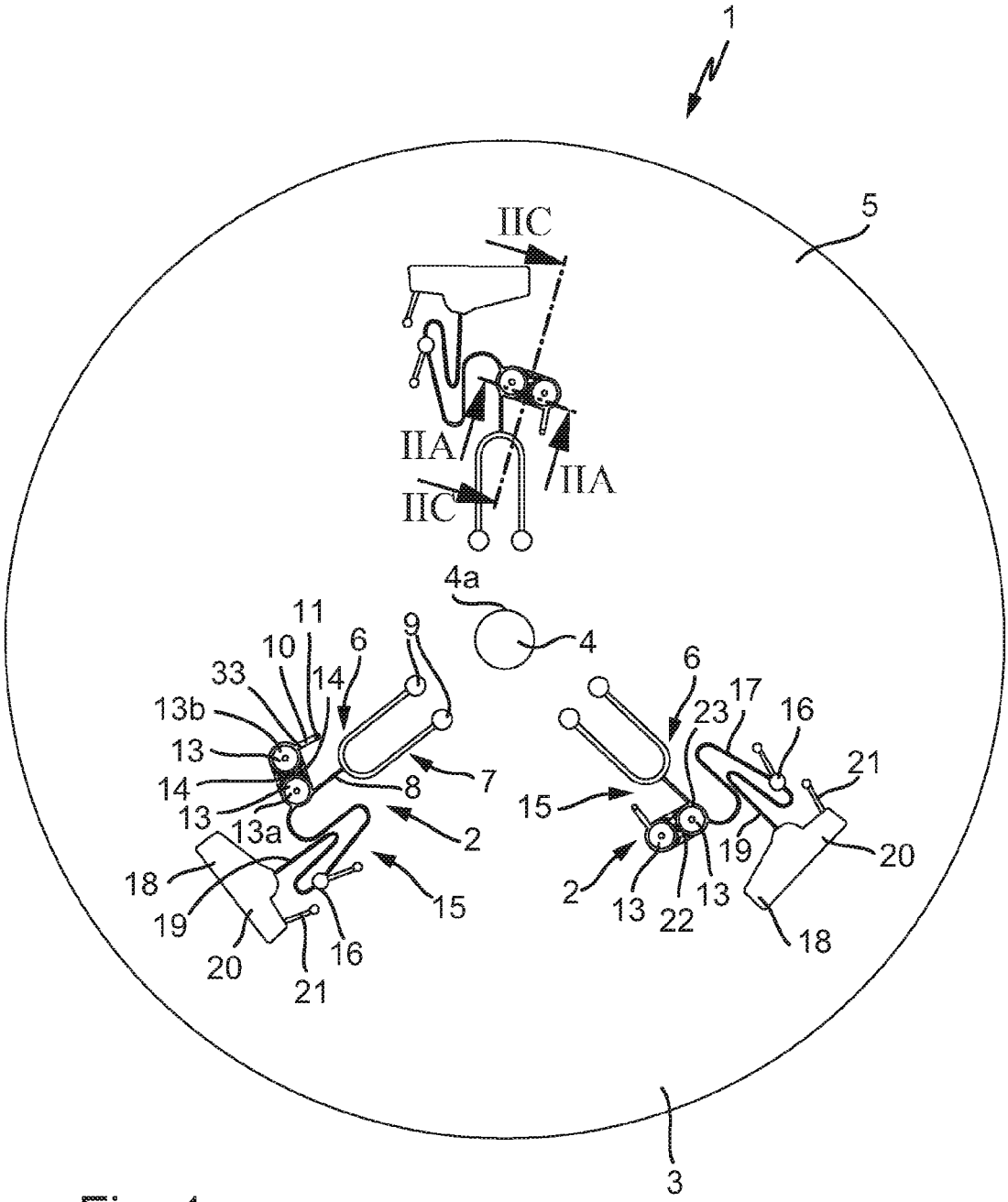
FIG. 1 shows a microfluidic element according to one embodiment of the disclosure, implemented as a test carrier, having three identical channel structures.

Skilled artisans appreciate that elements in the figures are illustrated for simplicity and clarity and have not necessarily been drawn to scale. For example, the dimensions of some of the elements in the figures may be exagerated relative to other elements to help improve understanding of the embodiment(s) of the present disclosure.

DETAILED DESCRIPTION

In the context of the present disclosure, a microfluidic element is understood as an element having a channel structure, in which the smallest dimension of the channel structure is at least 1 μm and its largest dimension (for example, length of the channel) is at most 10 cm. Because of the small dimensions and the capillary channel structures, laminar flow conditions predominantly prevail in the channels or channel sections. The poor conditions resulting therefrom for blending of liquid and solid in such capillary channels are significantly improved by the microfluidic element according to the embodiments of the instant disclosure.

The microfluidic element rotates around a rotational axis. The rotational axis typically extends through the microfluidic element. It extends through a predetermined position, e.g., typically through the center of gravity or the center point of the element. In a typical embodiment, the rotational axis extends perpendicularly to the surface of the fluidic element, which typically has a flat, disc-like form and can be a round disc, for example. For this purpose, the microfluidic element is held in a holder of an analysis device, for example, the rotational axis being formed by a rotating shaft of the device.

Through corresponding structuring of a substrate of the element, a channel structure is formed, which comprises a feed channel having a feed opening and a ventilation channel having a ventilation opening as well as at least two reagent chambers. A reagent is contained in at least one of the reagent chambers, which is typically provided in solid form as a dry reagent and which reacts with the liquid sample, which is introduced into the channel structure. Each two adjacent reagent chambers are connected to one another via at least two connection channels in such a manner that a fluid exchange is made possible between the two reagent chambers. One of the reagent chambers has an inlet opening, which has a fluid connection to the feed channel so that a liquid sample can flow from the feed channel into the reagent chambers. According to one embodiment, the liquid sample flows out of the feed channel into the reagent chamber which, of the (two) reagent chambers, is farther away from the rotational axis. The liquid thus flows into the rotational-axis-distal reagent chamber.

The expressions used in the meaning of the disclosure, "rotational-axis-distal" and "rotational axis-proximal", do not represent absolute area specifications, of where a structure is located, but rather specify how far away a structure is from the rotational axis. The rotational axis is understood as the zero point of a distance scale, which extends radially outward from the rotational axis. A rotational-axis-distal (rotational-axis-remote) structure is farther away from the rotational axis in this meaning than a rotational-axis-proximal structure. A rotational-axis-distal reagent chamber (reagent chamber which is distal to the rotational axis) is thus the reagent chamber which is farther away from the rotational axis in relation to another reagent chamber. In the case of two reagent chambers, the rotational-axis-distal reagent chamber is the chamber which is farthest away from the rotational axis in comparison to other chambers, i.e., the most distal of the reagent chambers. The term "rotational-axis-proximal" is to be understood in a similar manner. In this meaning, a rotational-axis-proximal reagent chamber is to be understood as the reagent chamber which—in comparison to the other reagent chambers—is located closest to the rotational axis.

In the context of the present disclosure, it has been recognized that—in contrast to the microfluidic elements known in the prior art—multistep reaction protocols are possible using the reagent chambers, which are connected via at least two connection channels, and the arrangement offers manifold control capabilities. In particular, the arrangement allows different reagents which are introduced separately from one another, without mixing during drying, to be dissolved in a single processing step, the dissolving not being fluidically obstructed.

The at least two connection channels between the two reagent chambers allow an unobstructed and rapid fluid exchange. In the context of the disclosure, it has been recognized that more than two connection channels are typical. Three connection channels are particularly typically used, which may be positioned essentially parallel to one another, for example. The reagent chambers are fluidically connected one behind another by the two connection channels in such a manner that a fluid series circuit results. The reagent chambers are geometrically independent component structures and have a separate receptacle volume. However, they are fluidically jointly a single fluid chamber. The positive properties of individual reagent chambers are therefore combined with the properties of a single fluid chamber. The solid dry reagents are introduced in liquid form into the chambers and then dried. This drying is performed either by heating or freezing, which typically occurs at temperatures of less than about −60° C., particularly typically at approximately −70° C. The test carrier is typically pre-cooled, in order to improve the drying of the liquid reagent. In particular, in the case of "surfactant-containing" reagents, "cold drying" by freezing is typical.

Since the reagent chambers are geometrically separated from one another, different reagents may be introduced into each of the reagent chambers, without mixing of the reagents occurring before or during the drying. This is supported by a corresponding geometric design of the reagent chambers. For example, the chambers can be separated by sharp delimitations such as webs or edges, in order to prevent blending ("crosstalk") by creeping effects. The sharp-edged delimitations do also form a barrier for the transport of the fluid out of a reagent chamber. However, this can be easily overcome by the occurring external forces (centrifugal force, hydrostatic force). Multiple (different) reagents can be dissolved and homogenized in only one processing step through the possibility of filling each chamber with a different reagent.

The arrangement of the reagent chambers of the channel structure is implemented in such a manner that one of the chambers is positioned farther away from the rotational axis than the other chamber, i.e., the distance of the rotational-axis-distal reagent chamber from the rotational axis is greater than the distance of the other chamber. Through the rotation of the microfluidic element, the liquid introduced into the channel structure is first conducted into the rotational-axis-distal chamber, so that this chamber is filled first and the reagent accumulated in the chamber is dissolved. The liquid reacts with the reagent. The liquid quantity and the volume of the first reagent chamber are adapted to one another.

The second (and possibly further more rotational-axis-proximal) reagent chamber is only filled when a larger liquid quantity is introduced into the channel structure or flows out of the feed channel into the reagent chambers. In this manner, reagents can also be dissolved very well using small sample quantities. The reagent chamber which is farthest away from the rotational axis is therefore filled first. The chambers positioned closer to the rotational axis (in relation to the most distal (remote) reagent chamber) are only filled in one or more further steps, the sequence of the filling being dependent on the distance to the rotational axis. The reagent chamber having the smallest distance to the rotational axis is filled last. In the context of the disclosure, it was recognized that dissolving of the reagents occurs more reliably, completely, and rapidly in completely filled reagent chambers than in only partially filled chambers. Through the arrangement of a plurality of reagent chambers having relatively small partial volumes, e.g., 2, 3, 4, 5, 6, 8, 10, 12, 15, etc. chambers, good blending can be achieved for a large number of different volumes. For example, three or five of the 12 reagent chambers, for example, can be filled with the volume to be assayed, all (e.g., three or five) chambers being completely filled. If all reagent chambers are filled with the same reagent or the same composition of reagents, very good blending with the reagents can be achieved in this manner for different volumes of sample liquid.

In a typical embodiment, the respective two (or more) connection channels between two adjacent reagent chambers are positioned parallel. The spaced-apart (separate) connection channels are typically formed by linear channel sections. The length of at least one of the connection channels is typically smaller than the smallest dimension of the reagent chambers in the test carrier plane. The test carrier plane is the plane which extends perpendicularly to the surface normals of the test carrier, for example, perpendicularly to the rotational axis.

One of the at least two connection channels is advantageously positioned centrally between adjacent reagent chambers. It is aligned with the centers of the two reagent chambers which it connects. The (other) connection channel is typically connected laterally to the reagent chambers in such a manner that it extends outside the central axis connecting the centers. It is particularly typically positioned tangentially on the reagent chambers, so that its outer side (outer wall) aligns with outer walls of the reagent chambers. The central connection channel is typically wider (it has a greater cross section at equal channel height) than the laterally positioned channel.

The connection channels between two adjacent reagent chambers are implemented so that upon filling of the reagent chamber arrangement, the liquid can flow through the connection channels from one chamber into the second. The liquid typically flows through one of the connection channels. The air contained in the not yet filled chamber can simultaneously escape through the other of the two channels, i.e., the channel which is not wetted by the liquid, typically through the central connection channel.

An embodiment having three connection channels between two adjacent reagent chambers is particularly typical. One connection channel extends along the central axis, which connects the centers of two adjacent reagent chambers. The two other connection channels are typically positioned tangentially on the reagent chambers. Upon filling of the reagent chambers, the rotational-axis-distal reagent chamber is filled first. For this purpose, liquid is conducted through the (tangential) connection channel, which is adjacent to the inlet opening, into the rotational-axis-distal chamber. Upon filling of the rotational-axis-distal reagent chamber, air escapes through the two other connection channels (the middle channel and the second tangential channel) until the reagent chamber is filled. Upon further filling, the air in the two other connection channels is displaced by liquid, so that further filling of the rotational-axis-proximal reagent chamber first occurs through the two other connection channels and finally also via the first connection channel, which is adjacent to the inlet opening.

In an arrangement of a fluidic element having three or more reagent chambers, the at least two connection channels (typically three connection channels) are each positioned between two adjacent reagent chambers. Two reagent chambers are adjacent if no further reagent chamber is positioned between them and a fluid exchange occurs between them directly via the at least two connection channels, without further fluidic structures being connected between them.

The channel structure according to an embodiment of the disclosure having at least two reagent chambers, which are directly connected to one another by at least two connection channels, offers high flexibility, a space-saving and compact arrangement, and an array of functional advantages:

1. A two-step reaction protocol is possible using two reagent chambers connected to one another. In a first step, a liquid quantity which corresponds to the volume of the first reagent chamber is conducted into the first rotational-axis-distal reagent chamber. The dry reagent contained therein is dissolved, so that the first reaction can occur. In a further step, a second liquid quantity is filled into the arrangement of the reagent chambers, the second partial quantity corresponding to the volume of the second reagent chamber. This second partial quantity of the liquid can be a buffer medium, for example. The filling procedure occurs in that the additional second partial quantity is first pressed into the first chamber by the centrifugal force and mixes with the fluid present therein and only then flows into the second reagent chamber. Through a corresponding control of the rotational velocity and rotational direction, a mixing procedure begins, in which the reagent in the second reagent chamber is dissolved and a second reaction with the second reagent occurs. Since both reagent chambers are completely filled during the dissolving in each case, good homogenization and blending in the different phases is achieved in each of the two chambers.
2. The reagent chamber arrangement offers the advantage that optimized dissolving of a dry reagent in the rotational-axis-distal first chamber occurs in that this chamber has the entire filling volume flow through it multiple times, two times if two reagent chambers are provided. A flow through the first reagent chamber first occurs upon the filling of the chamber. The second flow through occurs upon emptying of the structure. In this manner, particularly good dissolving of the dry reagent is achieved. This has the further advantage that the agglomerates resulting during drying of reagents, which are pressed radially outward into the first chamber by the centrifugal force, are also "flushed out" with the fluid from the radially inner chamber during the subsequent emptying. Losses on the inner surface of the first reagent chamber are prevented.
3. Dilution series may be implemented in a simple manner using the arrangement according to another embodiment of the disclosure. Since the arrangement of the reagent chambers allows a very compact channel structure, a plurality of channel structures may be implemented on one test carrier. To perform a dilution series, only the respective rotational-axis-distal first reagent chamber is equipped with reagents in the channel structures positioned in parallel. To perform a dilution series, the parallel structures are filled with different volumes, so that different dilutions can be generated in only one processing step for a defined reagent quantity. The advantage of such a sequential microreactor cascade using a so-called pearl necklace structure (series circuit of multiple chambers) is that the complete reaction can be performed using variable volumes, without having to perform changes in the geometry of the channel structure. The smallest volume of the sample liquid is as large as the volume of the first reagent chamber. The volumes to be assayed are typically a multiple of the typically equal volumes of the individual reagent chambers.
4. A further advantage of the reagent chamber structure is that the individual reagent chambers can be adapted to the partial volumes to be assayed. In the context of the disclosure, during experiments on the dissolving and mixing behavior, it has been recognized that the mixing procedures run optimally with completely filled chambers. For example, if only a partial quantity of the fluid is available in a first filling step, for example, a dilution buffer, which is only filled up later with a sample liquid, in a "single chamber system", the homogenization with the first partial quantity would only run very poorly, since air inclusions would be formed. In a reagent chamber arrangement having multiple reagent chambers, the chambers are each designed for the partial volume of the liquid to be assayed and thus allow optimum dissolving and mixing, since the individual reagent chambers are completely filled by the liquid partial volumes. Foaming of the solution is also prevented.

To further improve the mixing procedures in the reagent chamber arrangement, in a typical embodiment, the channel structure comprises a mixing chamber, in which the reagent chambers and the connection channels between the reagent chambers are integrated. In this manner, the properties of the individual reagent chambers are combined still better with the properties of a fluidic individual chamber. The reagent chambers are typically positioned in the mixing chamber in the radial direction in series in such a manner that the series of the chambers encloses an angle of at most 80° to the radial direction, particularly typically at most 60°. The radial direction is to be understood as a straight line which extends outward from the rotational axis of the microfluidic element or the test carrier. Therefore, the reagent chambers do not have to be oriented directly radially outward, but rather can enclose an angle to the radial direction which is different from 90°.

In a further typical embodiment, the reagent chambers are implemented so that filling with a liquid and dissolving of a solid dry reagent contained in the reagent chamber occur without the liquid flowing into the adjacent reagent chamber. As long as the liquid quantity does not exceed the volume of the reagent chamber, the liquid remains in the reagent chamber into which it flows. During the first filling, this is always the rotational-axis-distal reagent chamber. It typically has an inlet opening, which has a fluid connection to the feed channel in such a manner that a liquid sample can flow into the rotational-axis-distal reagent chamber.

The reagent chambers typically have a round design. Their footprint is implemented as circular. The base of the individual chambers is rounded so that the base merges continuously into the chamber walls, i.e., without an edge. The reagent chambers are typically implemented in the form of a hemisphere or a hemispherical segment. A web which separates the two chambers is implemented between two adjacent chambers. An edge is provided at the upper edge of the chamber, so that a capillary stop is formed, which prevents an exit of liquid from one of the reagent chambers. This web-like barrier is designated in technical circles as a plate edge. Of course, the edge in the transition does not have to be sharp-edged. It can also have a small radius. However, the radius is to be selected as sufficiently small that the barrier function is maintained.

The reagent chambers, which are each connected to one another by at least two connection channels, are typically integrated in a mixing chamber. The mixing chamber consists of the reagent chambers, the connection channels, a feed opening, through which the liquid can enter the mixing chamber from a feed channel, and a ventilation opening, which is positioned at the end of a ventilation channel, which has an air exchange connection with the mixing chamber. In addition, the mixing chamber can also comprise a transport channel, which is led laterally along the reagent chambers.

Reagent chambers having a rounded base or a rounded depression are also suitable as a structure, independently of the use in rotating test carriers and centrifugal devices, for introducing two or more reagents individually into the structure and only mixing them jointly at a later point in time upon dissolving with a liquid. This is true in particular for reagents which react to one another, but may only be mixed with one another at an analysis point in time (for example, upon dissolving with plasma), but not beforehand. They are only to dissolve jointly in the analysis. The statements made in the description of the figures herein with respect to rotating test carriers can therefore also be transferred to nonrotating test carriers, in which the reagent chambers have a rounded base and typically have a hemispherical design.

Hemispherical reagent chambers, which are typically combined in a mixing chamber, also have a large advantage during the introduction and during the drying of reagents. The reagents are introduced in liquid form into the reagent chambers and dried therein. The surface tension acts during the drying procedure, so that the dosed liquid reagent wets the surroundings of the application point and is slowly distributed. If it hits edges or similar points which have a higher capillarity, it dries in concentrated form thereon. Such concentration is prevented by the rounded base. Since only one reagent is applied per reagent chamber, flowing together and mixing is also prevented. This is assisted by the sharp-edged upper boundaries of the chambers. The reagent chambers having rounded base also prove to be particularly advantageous during the dissolving of the reagents.

FIG. 1 shows a microfluidic element 1 having three identically constructed channel structures 2, which extend essentially radially outward. The smallest dimension of the channel structure 2 is typically at least 0.1 mm, particularly typically at least 0.2 mm in size. The microfluidic element 1 is a test carrier 3, which is implemented as a rounded disc and through which a rotational axis 4 extends centrally, around which the disc-shaped test carrier 3 rotates. The channel structure 2 is enclosed by a substrate 5 and a cover layer (not shown), which covers the test carrier 3 on top.

The microfluidic element 1 is suitable for use in an analysis device or a similar device, which has a holder, in order to accommodate the microfluidic element and cause it to rotate. The device is typically implemented so that the microfluidic element is rotated around a rotating shaft of the device, the axis of the rotating shaft aligning with the rotational axis 4 of the microfluidic element 1. The rotating shaft of the device can extend through a hole 4*a* of the test carrier 3 for this purpose. The rotational axis 4 typically extends through the center point or the center of gravity of the element 1.

The channel structure 2 of the microfluidic element 1 includes a feed channel 6, which comprises a U-shaped channel section 7 and a linear channel section 8. A feed opening 9 is provided at each of the ends of the two U-legs of the U-shaped channel section 7, through which a liquid sample, typically a bodily fluid such as blood, for example, can be introduced into the feed channel 6. For example, a sample liquid can be dosed by an operator manually (using a pipette) into a feed opening 9. Alternatively, the feed channel can also be equipped with a liquid by means of a dosing station of an analysis device. During the dosing of a liquid into the feed channel 6, the liquid is introduced through one of the two feed openings 9, while the air contained in the channel can escape through the second feed opening.

Furthermore, the channel structure 2 comprises a ventilation channel 10 having a ventilation opening 11 as well as two reagent chambers 13, which are connected to one another via three connection channels 14 so that a fluid exchange occurs between the two reagent chambers 13. The channel structure 2 is implemented in a typical embodiment according to FIG. 1 as an analysis function channel 15, which comprises a measuring chamber 16, a measuring channel 17 between the measuring chamber 16 and the reagent chambers 13, and a waste chamber 18, which is connected via a disposal channel 19 to the measuring chamber 16. The measuring chamber 16 is ventilated via a separate ventilation channel. The waste chamber 18, which is implemented as a collection basin 20, has a ventilation channel 21 having an outlet valve at the end, through which air can escape from the channel structure 2.

In a typical embodiment, as shown in FIG. 1, for example, the channel structure 2 comprises a mixing chamber 22, in which the two reagent chambers 13 and the three connection channels 14 are integrated. The mixing chamber 22 has an inlet opening 23, which has a fluid connection to the feed channel 6, so that a liquid sample can flow into the rotational-axis-distal reagent chamber 13*a*. The rotational-axis-distal reagent chamber 13*a* has a greater distance to the rotational axis 4 than the other reagent chamber 13*b*. The rotational-axis-proximal reagent chamber 13*b* (closer to the rotational axis 4 than the reagent chamber 13*a*) is in fluid contact via an air outlet 33 with the ventilation channel 10, so that air can escape from the reagent chamber arrangement and the mixing chamber 22.

If a liquid is introduced into the U-shaped channel section 7 and the test carrier 3 is then rotated around a rotational axis 4, the centrifugal force presses the liquid through the linear channel section 8 of the feed channel 6 until the liquid reaches the mixing chamber 22 through the inlet opening 23. The liquid is then collected in the rotational-axis-distal reagent chamber 13*a* until it is filled. A dry reagent which is dried in the reagent chamber 13*a* is dissolved. If further liquid is introduced into the mixing chamber 22, the liquid flows through the three connection channels 14 into the more rotational-axis-proximal reagent chamber 13*b*, the connection channel 14 located farthest radially outside first being filled with liquid. The air contained in the mixing chamber 22 escapes outward through an air outlet 33 in the ventilation channel 10.

Optimum dissolving of the reagents can occur in the reagent chambers 13 through suitable control of the rotational velocity, the rotational direction, and the acceleration, which is supported by the rounded reagent chambers 13.

Figure 2A:
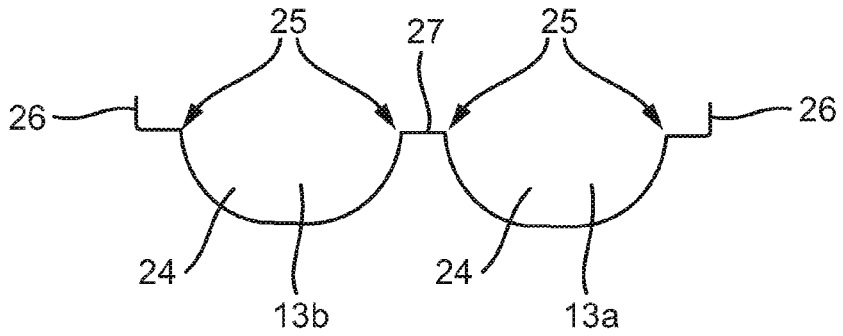
FIGS. 2*a, b, c* show sectional views through a channel structure from FIG. 1.

FIG. 2*a* shows a section along line IIA from FIG. 1 through the two reagent chambers 13*a*, 13*b*. The reagent chambers 13*a*, 13*b* are typically implemented as hemispherical, the open opening surface of the hemispheres 24 being terminated by the cover layer. The reagent chambers 13 are rounded on their base so that no sharp edges occur. The rounded chamber base thus ensures uniform distribution of the reagent and also uniform dissolving and uniform flow velocity. The transitions to the connection channels are typically not rounded, but rather sharp-edged, i.e., a sharp edge 25 is implemented at the upper boundary of the hemispheres 24, the edge 25 typically enclosing an angle of 90°. A type of geometrical valve results in this manner, which forms an overflow protection, since the edge represents a physical barrier for the transport of the liquid.

In order to place the reagents in the chamber, the reagents provided in liquid form are introduced into the open test carrier 3 without cover layer, for example, by pipetting. The sharp edges are then used as a delimitation, which prevents creeping of the liquid reagents during the drying. The structure therefore becomes independent with respect to interfering effects during the automatic processing upon the drying. An overflow protection 26 adjoins the reagent chambers 13 at the upper boundary, which prevents reagents from being able to exit from the mixing chamber 22. The surface enlargement by the overflow protection 26 can additionally lengthen the mixing time during the mixing or dissolving of the dry reagents.

Figure 2B:
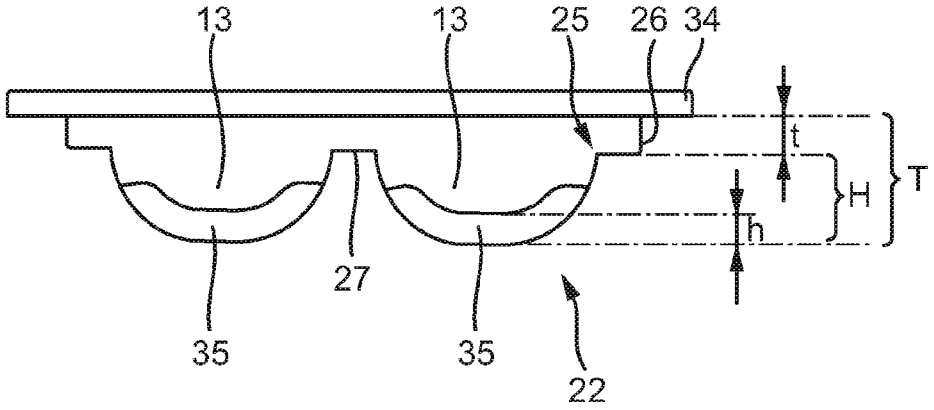

FIG. 2*b* shows the section through the channel structure 2 from FIG. 2*a*, but with dry reagents 35 and cover layer 34 shown. The reagent chambers 13 and the mixing chamber 22 are implemented here so that the depth t of the overflow protection 26 is approximately one-third of the depth T of the mixing channel 22. The depth t of the overflow protection 26 is approximately 400 μm. Two-thirds of the depth T of the mixing channel 22 is formed by the reagent chambers 13. The dried reagent 35 covers the base and the inner surfaces of the hemispheres 24, the fill level h of the dry reagent 35 on the base corresponding to approximately half of the height H of the hemisphere 24. At the boundaries, the reagent 35 flows further upward during the drying; however, it is prevented by the physical barrier and the edge 25 from creeping further over the web 27 formed between the two chambers 13*a*, 13*b*. The web 27 typically extends between two adjacent reagent chambers 13 in the direction toward the cover layer 34 and thus separates the two reagent chambers 13*a*, 13*b* of the mixing chamber 22.

Figure 2C:
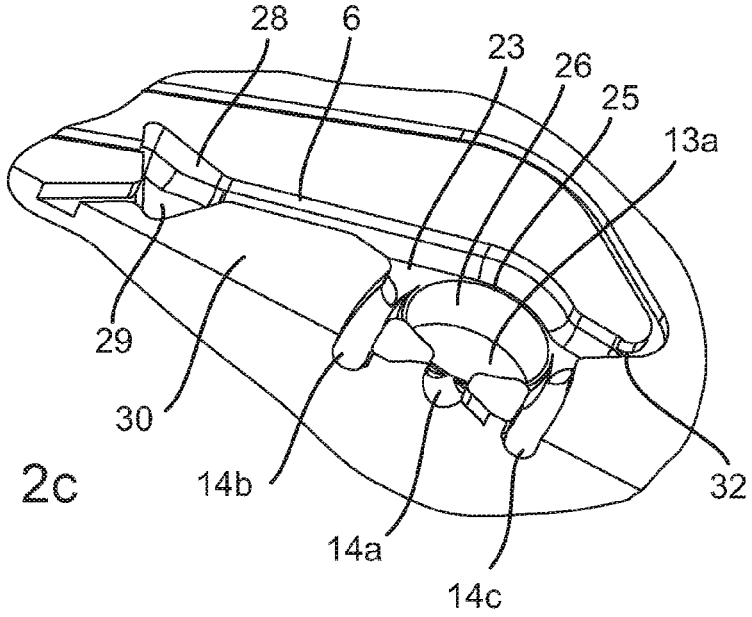

FIG. 2*c* shows a three-dimensional view in the area of line 11*c* from FIG. 1 through the connection channels 14 of the channel structure 2. The feed channel 6 has a return barrier 28, which is implemented as a microfluidic valve 29. The depth of the feed channel 6 from the surface 30 of the microfluidic element 1 is in the same order of magnitude as the depth of the connection channels 14. However, it is significantly greater than the depth of the rotational-axis-distal reagent chamber 13*a*. The depth of the feed channel 6 is thus also approximately 400 μm. A liquid which flows due to rotational force from the feed channel 6 into the overflow protection 26 of the mixing chamber 22 flows over the edge 25 into the hemispherical reagent chamber 13*a*. Through rotation of the test carrier 3, the inflowing liquid is moved into the reagent chamber 13*a* and thus dissolves the dry reagent (not shown here) contained therein.

Upon the inflow of further liquid, it is also conducted through the connection channels 14*a*, 14*b*, and 14*c* into the further reagent chambers 13 (not shown). In the context of the disclosure, it has been established that the outgoing transitions from the reagent chamber 13, which is implemented as a hemisphere 24, into the capillary connection channels 14*a*, 14*b*, 14*c* typically cannot be smaller than 0.4×0.4 mm in cross section (or its diameter cannot be smaller than 0.4 mm) and can only gradually taper later. In connection channels 14 having a smaller cross section, the applied capillary force is so great that overflow ("crosstalk") occurs, in particular of the liquid reagents before the drying.

The channel structure 2 having reagent chambers 13 which are rounded on the base may also be used in nonrotating test carriers. A liquid driven by an (external) force first flows in the case of a nonrotating microfluidic element 1 into the first reagent chamber 13*a*, fills it completely, and dissolves the reagent contained therein. Not only uniform distribution of the reagent is ensured by the rounded base of the chamber. The dissolving of the reagent also occurs in an optimized manner. Only the inflow of further (force-driven) liquid may overcome the edge 25, so that it can flow through the connection channels 14 into the adjacent reagent chamber. The reagent contained therein is therefore only dissolved in a second step.

Figure 3:
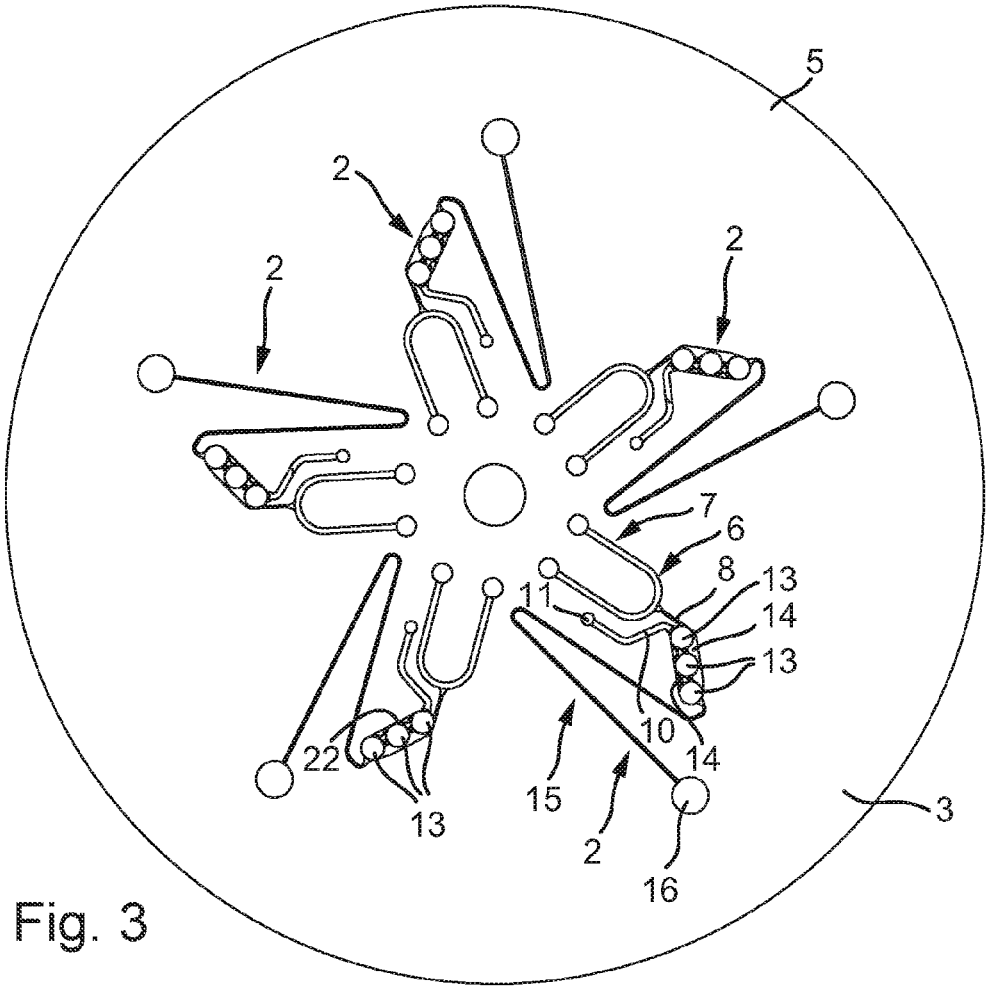
FIG. 3 shows a test carrier according to another embodiment of the disclosure.

FIG. 3 shows an example of a further embodiment of a test carrier 3, having five identical channel structures 2. The feed channel 6 also has a U-shaped channel section 7 and a linear channel section 8. The mixing chamber 22 also has, on its rotational-axis-proximal end, a ventilation channel 10 having a ventilation opening 11. The channel structure 2 is also implemented as an analysis function channel 15 and comprises a measuring chamber 16 in this arrangement.

Figure 4:
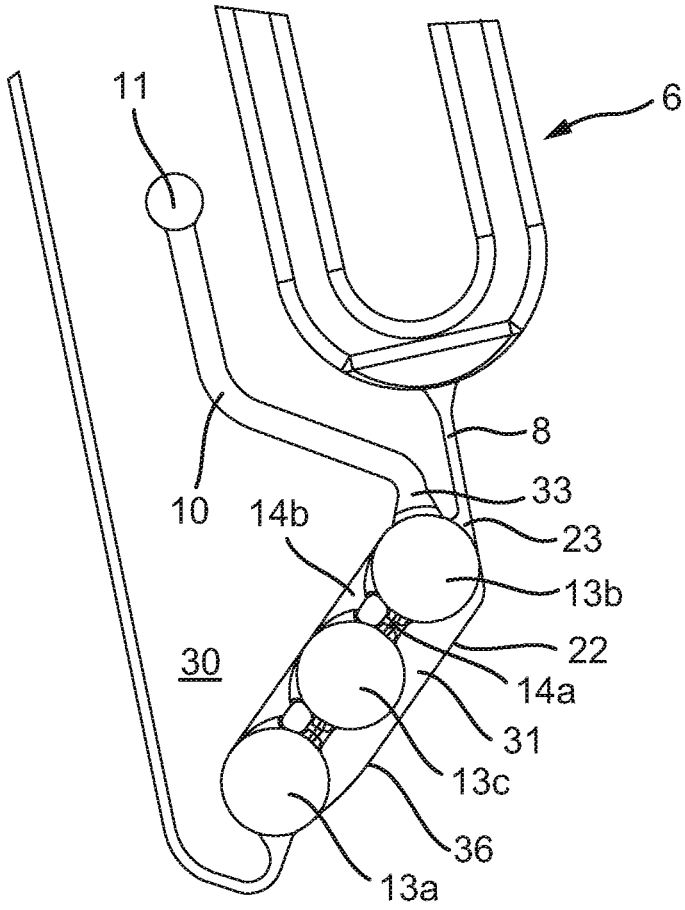
FIG. 4 shows a detail view of a channel structure having three reagent chambers in accordance with an embodiment of the disclosure.

FIG. 4 shows a detail view of the mixing chamber 22 from FIG. 3 having the three reagent chambers 13*a, b, c* connected in series and two connection channels 14 in each case, namely a central connection channel 14*a* and a lateral (rotational-axis-proximal) connection channel 14*b* in each case. The mixing chamber 22 typically has a rotational-axis-proximal inlet opening 23, through which liquid enters the mixing chamber 22 from the feed channel 6. A capillary transport channel 31 is typically positioned on the rotational-axis-distal long boundary 36 of the mixing chamber 22. The transport channel 31 extends laterally and radially outside on the reagent chambers 13 positioned in series. Its depth (considered from the surface 30 of the test carrier 3) is, at approximately 150 to 200 μm, less than the depth of the connection channels. The entering liquid is conducted through the transport channel 31 into the reagent chamber 13*a*.

The ventilation channel 10 is wider than the feed channel 8 and wider than the connection channels 14 between the reagent chambers 13. In this manner, a smaller capillary force is generated by the ventilation channel 10, so that no liquid penetrates into the ventilation channel 10. In addition, the ventilation channel 10 is always positioned rotational-axis-proximal, so that the liquid cannot reach the ventilation channel 10 from the reagent chambers 13 during the rotation. During the filling of the reagent chamber 13*a*, the air contained therein already escapes through the connection channels 14*a* and 14*b* into the closest reagent chamber 13*c*. As soon as the reagent chamber 13*a* is completely filled, liquid flows through the two connection channels 14*a* and 14*b* into the reagent chamber 13*c*. The filling of the second reagent chamber 13*c* thus also initially occurs at least partially through the connection channels 14*a*, 14*b* and through the transport channel 31.

The air contained in the second reagent chamber 13*c* escapes through the connection capillaries 14*a* and 14*b*, which form the connection to the rotational-axis-proximal reagent chamber 13*b*. It is ensured in this manner that no air is enclosed in the reagent chambers 13*a*, 13*b*, and 13*c*. The air escapes from the reagent chamber 13*b* via the ventilation channel 10. Typical filling of the reagent chambers 13 from radially outside to radially inside is made possible in this manner.

The arrangement according to the embodiments of the disclosure already allows mixing of the liquids upon dissolving of the reagents, in particular upon dissolving of the reagents in the second and further reagent chambers 13. The degree of dissolving is therefore particularly high and effective.

Figure 5A:
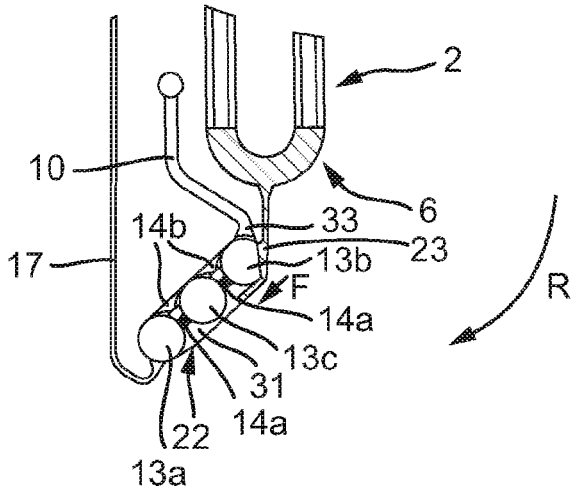
FIGS. 5*a*, 5*b* and 5*c* show detail views of a channel structure in accordance with an embodiment of the disclosure having three reagent chambers upon filling.
Figure 5B:
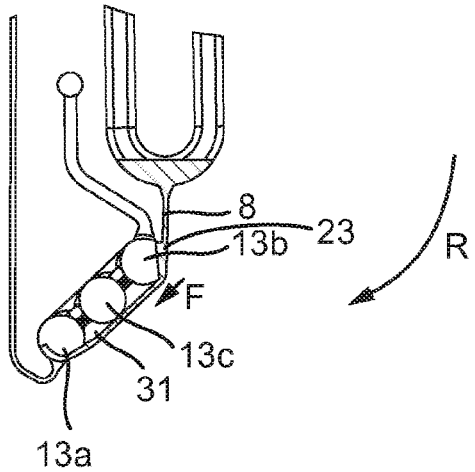
Figure 5C:
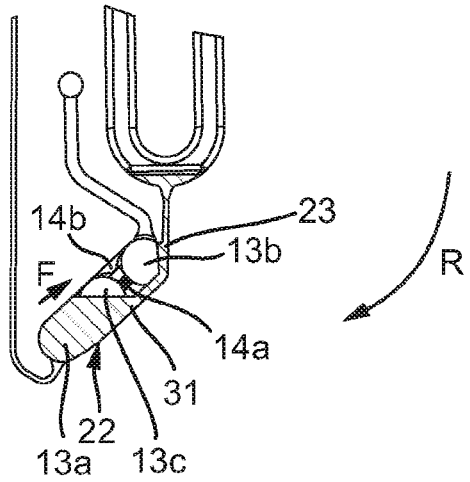

The filling of the reagent chambers 13*a, b, c* of the mixing chamber 22 will be explained in greater detail on the basis of FIGS. 5*a* to 5*c*. Liquid entering the mixing chamber 22 is conducted via the capillary-active transport channel 31, which is adjacent to the inlet opening 23, past the two rotational-axis-proximal reagent chambers 13*b*, 13*c* and flows into the rotational-axis-distal reagent chamber 13*a* (arrow direction F). The inflowing liquid is held by capillary action in the transport channel 31. During the rotation of the test carrier 3 (in the arrow direction R, clockwise here), the liquid is then pressed at the rotational-axis-distal end of the mixing chamber 22 into the reagent chamber 13*a* and dissolves the dry reagent contained therein. Upon filling, air escapes from the reagent chamber 13*a* via the connection channels 14*a*, 14*b* and the chambers 13*c*, 13*b* and the ventilation channel 10. As soon as further liquid flows after, it is conducted through the transport channel 31 into the reagent chamber 13*a* and conducted therefrom at least partially through the central connection channel 14*a* and the tangential connection channel 14*b* into the middle reagent chamber 13*c*. The further filling is performed directly via the transport channel 31 until the reagent chamber 13*c* is filled. Upon further inflow of liquid from the feed channel 6, the rotational-axis-proximal reagent chamber 13*b* is finally also filled, in that the liquid first flows through the central and tangential connection channels 14*a, b* and also through the transport channel 31 and later directly into the chamber 13*b*. The air contained in the reagent chambers 13 finally escapes through the air outlet 33 and the ventilation channel 10.

In the example according to FIGS. 4 and 5, the reagent chambers 13 have an individual volume of 3 μL, so that the three reagent chambers jointly have a volume of approximately 9 μL. The volumes of the individual reagent chambers 13 are typically between 3 μL and 10 μL. Reagent chambers having a volume of 2 μL or only 1 μL are also conceivable, as are reagent chambers 13 having a volume of 20 μL, 50 μL, 100 μL, or 500 μL.

Figure 6:
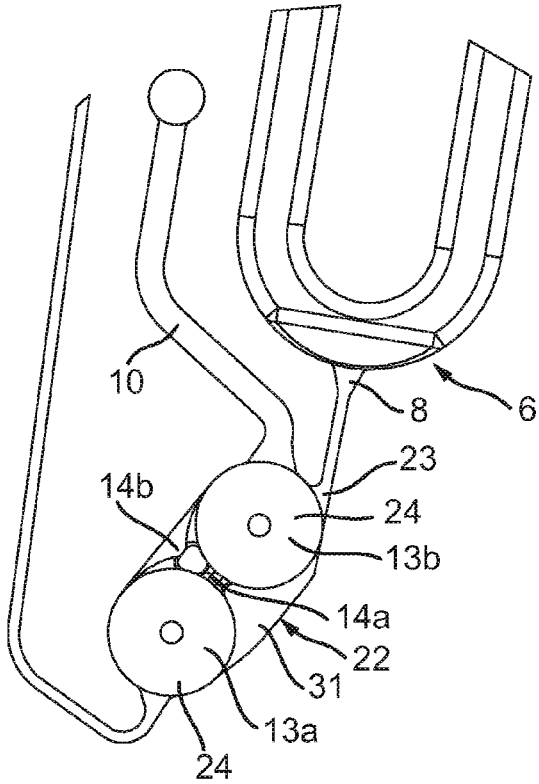
FIG. 6 shows an embodiment of the disclosure having two reagent chambers.

FIG. 6 shows a further typical embodiment having a mixing chamber 22, in which two reagent chambers 13*a*, 13*b* are integrated. A capillary transport channel 31 is also provided here, through which liquid entering the mixing chamber 22 is guided to the rotational-axis-distal reagent chamber 13*a*, which is the reagent chamber farthest away from the rotational axis of the two reagent chambers 13*a*, 13*b*. The rounded reagent chambers 13, having the rounded base, which are typically implemented as hemispheres 24, do not only ensure a homogeneous reagent application of the still liquid reagent. They have also been shown to be extremely suitable if the test carrier 3 is operated in a shake mode, in which the rotational velocity and rotational direction are changed according to a typically serrated activation curve. In this method, which is known as "Euler mixing", and which guarantees good homogenization and dissolving of the dry reagents, the mixing can be increased further by the rounded geometry. It has been recognized in the context of the disclosure that the most effective exchange and the most effective blending occurs at the boundaries and walls of the reagent chambers 13. Therefore, the connection channels 14 are positioned on the boundary, e.g., tangentially to the reagent chambers 13, in at least one of the two adjacent reagent chambers 13. It has proven to be advantageous to form the connection channels 14 without edge transitions on the reagent chambers 13.

In addition, it has been recognized in the context of the disclosure that a plurality of reagent chambers having connection channels transport the fluid through the connection channels 14 from chamber 13 to chamber 13 during the "Euler mixing" and diffuse exchange and good mixing efficiency can be provided in combination with the rounded surfaces.

Since the reagent chambers 13 are typically positioned adjacent in such a manner that their spacing is smaller than the smallest dimension of the reagent chambers 13 in the test carrier plane, a rapid fluid transport from one chamber 13 into the other is also possible. The smallest spacing is defined in the context of the disclosure as the smallest distance between the reagent chambers 13 or between the reagent chamber outer walls, respectively. At least the centrally located connection channel 14*a* between two reagent chambers 13 is therefore shorter than the smallest dimension of the reagent chambers 13. In the example shown in FIG. 6, the central connection channel 14*a* is approximately 0.2 mm long. Its width and depth are each 0.4 mm. The reagent chambers 13 have a height of 1.4 mm. The diameter of the reagent chambers is 1.95 mm. Through this geometrical arrangement, an unobstructed fluid transport between two adjacent reagent chambers 13 is possible. The fluid can be transported rapidly from one chamber to the other through the short connection channels 14. The transport occurs directly without interposed valve structures, lever arrangements, or siphon-like channel structures, whose length is a multiple of the reagent chambers. In this manner, the processing sequence using the reagent chambers according to the disclosure is very rapid and saves time. In addition, controlled and defined dissolving of different dry reagents which are contained in individual reagent chambers 13 may be performed.

Through the modular construction having small reagent chambers 13, it is possible to provide test carriers 3, which may be expanded arbitrarily based on this principle. Therefore, not only two or three, but rather also a plurality of chambers may be connected in series.

In addition to the round hemispherical reagent chambers, other forms of the reagent chambers are also possible, for example, droplet-shaped reagent chambers or, if two reagent chambers are used, which are integrated in a mixing chamber 22, e.g., so-called "Yin Yang embodiments". These reagent chambers are typically also rounded on the base. Oval and round chamber forms prove to be advantageous above all.

Figure 7:
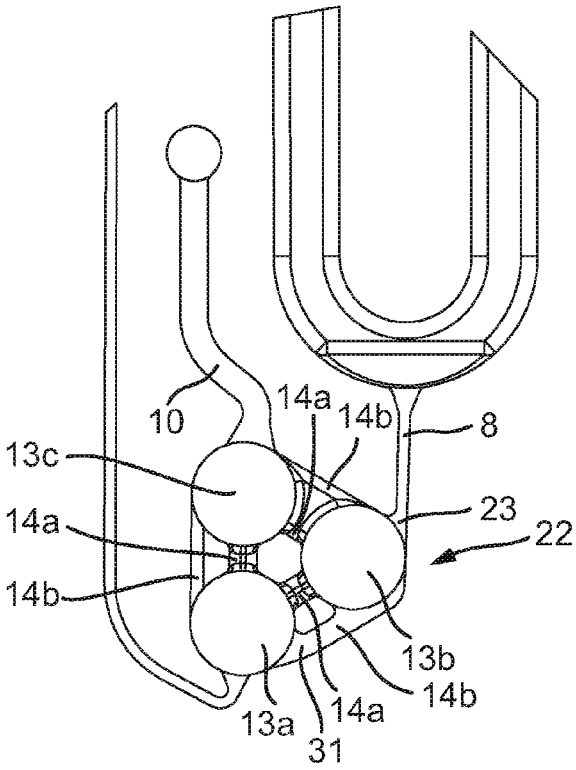
FIG. 7 shows another embodiment of the disclosure having three reagent chambers.

FIG. 7 shows a star-shaped arrangement of three reagent chambers 13 in a mixing chamber 22. The rotational-axis-distal mixing chamber 13*a* is also filled first via the transport channel 31 in this arrangement. As further liquid flows in, the two rotational-axis-proximal reagent chambers 13*b*, 13*c* are then filled jointly. Only one central connection channel 14*a* is provided between the reagent chambers 13*a* and 13*b*, since the capillary transport channel 31 is used as the second connection channel 14*b*.

Figure 8A:
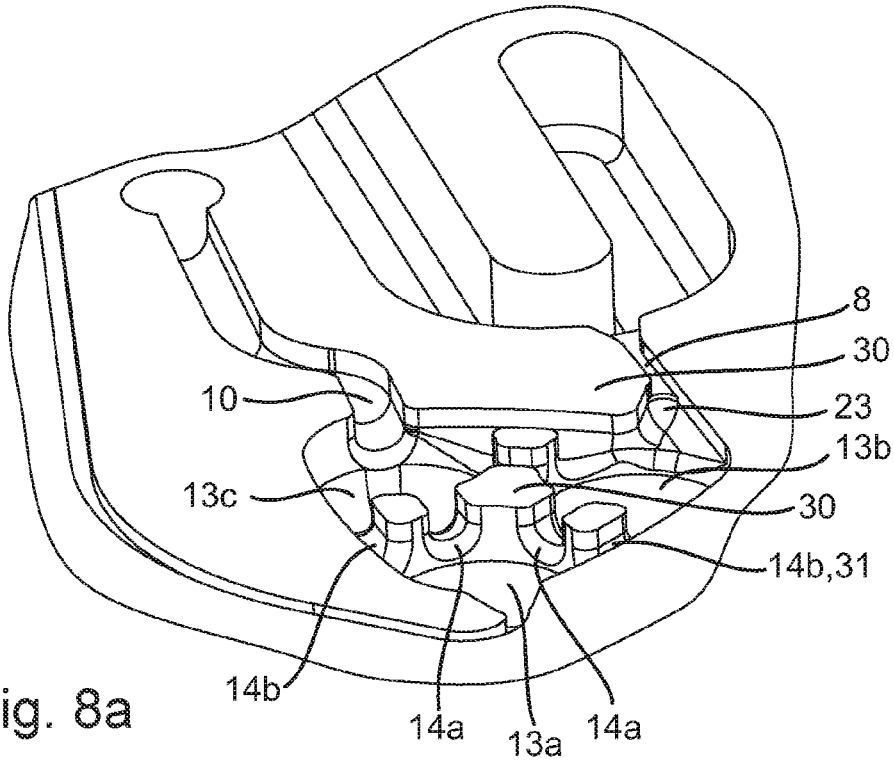
FIGS. 8*a* and 8*b* each shows a perspective view of the arrangement from FIG. 7.
Figure 8B:
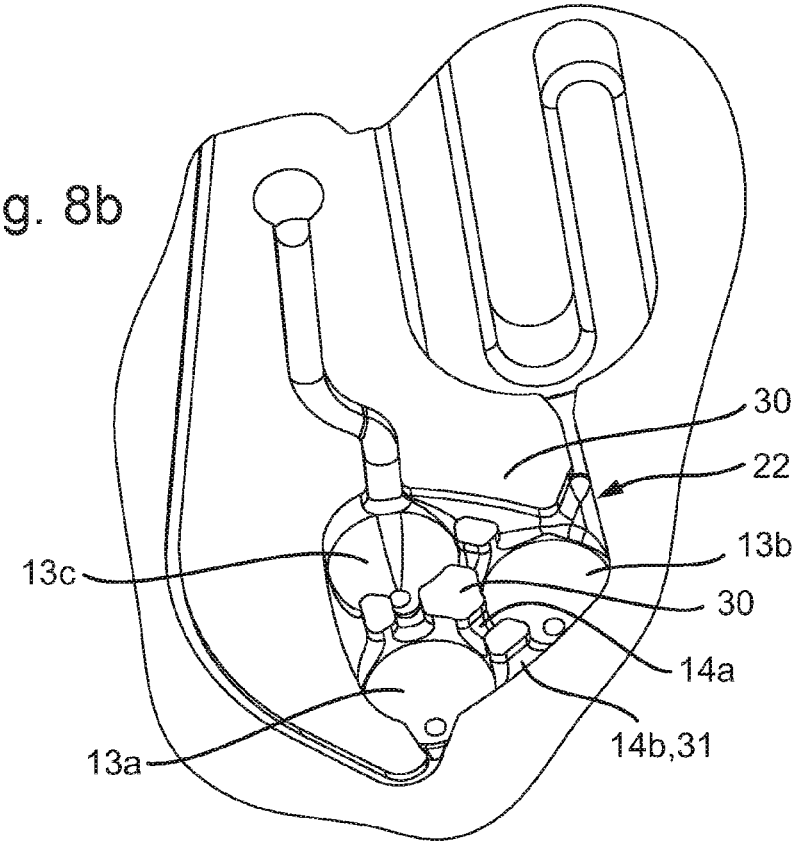

Three-dimensional views of such a star-shaped reagent chamber arrangement are shown in FIGS. 8*a* and 8*b*. The rounded connection channels 14 between the reagent chambers 13 and the rounded hemispherical reagent chambers 13 themselves are clearly recognizable. It can be recognized in this embodiment that the transport channel 31 also functions fluidically as a connection channel 14.

Figure 9:
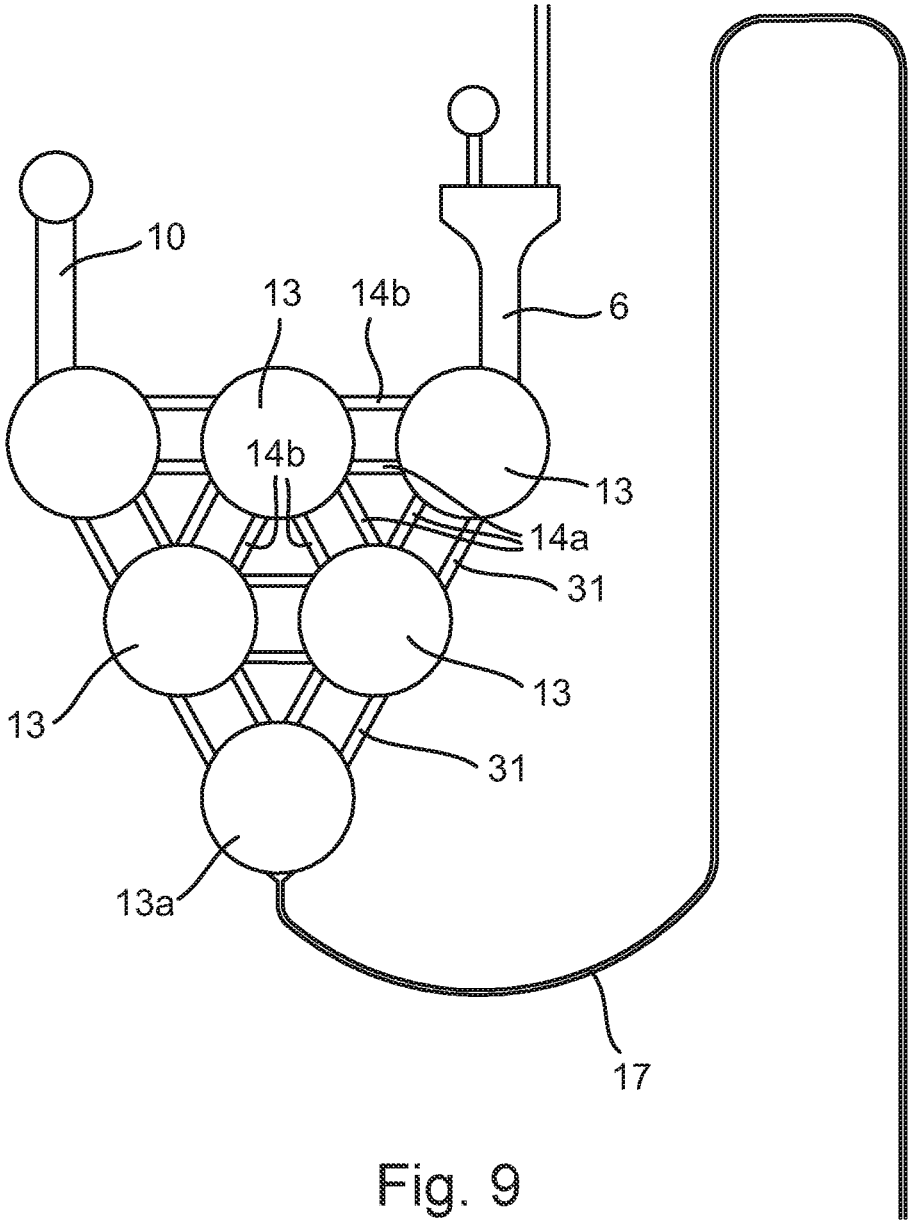
FIG. 9 shows an arrangement in accordance with an embodiment of the disclosure having six reagent chambers.

FIG. 9 shows that a star-shaped or circular arrangement of reagent chambers 13 can also be expanded. Thus, as shown here, six reagent chambers 13 can be fluidically interconnected, the principle being maintained that the reagent chamber 13*a* most distal to the rotational axis (rotational-axis-remotest reagent chamber) is filled first. Filling of the further chambers then begins from the rotational-axis-distal chamber 13*a*, which is located farthest away from the rotational axis 4.

During the rotation of the test carrier, the fluid is moved through all reagent chambers, in the star-shaped arrangement precisely as in the serial arrangement. Very efficient dissolving and mixing as well as targeted control of the liquid quantities may be achieved in this manner. The very compact and small arrangement obtained in this case has the advantage that a plurality of cascaded channel structures 2 may be positioned on one test carrier 3.

The drying process of two reagents in a microfluidic element 1 at different points in time will be explained on the basis of FIGS. 10*a* to 10*c*, a view from below and also a section being shown in each figure.

The drying of the initially liquid reagents will be explained based on two reagent chambers 13, which are separated from one another and have a fluid connection to one another via connection channels 14. The two reagent chambers 13*a*, 13*b* are integrated in a mixing chamber 22. A web 27 is positioned between the two reagent chambers 13*a*, 13*b*, so that the two chambers 13 are spatially spaced apart from one another. The connection channels 14 are introduced into the web 27. The embodiment shown here has three connection channels 14*a*,

14*b*, 14*c*, the connection channel 14*a* being a central channel and the two further connection channels 14*b* and 14*c* each being positioned laterally.

Figure 10C:
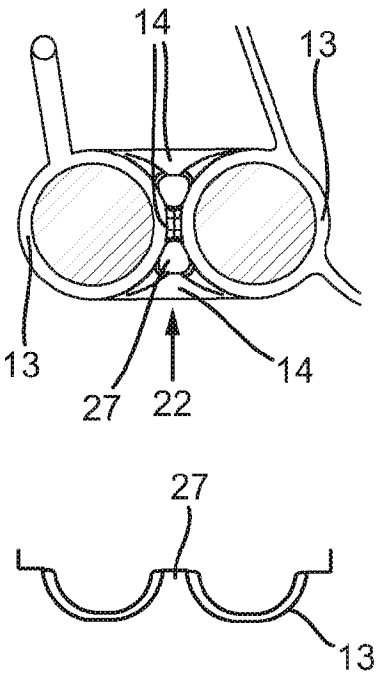
FIGS. 10*a, b, c* show an arrangement according to an embodiment of the disclosure having two reagent chambers during drying of liquid reagents.
Figure 10B:
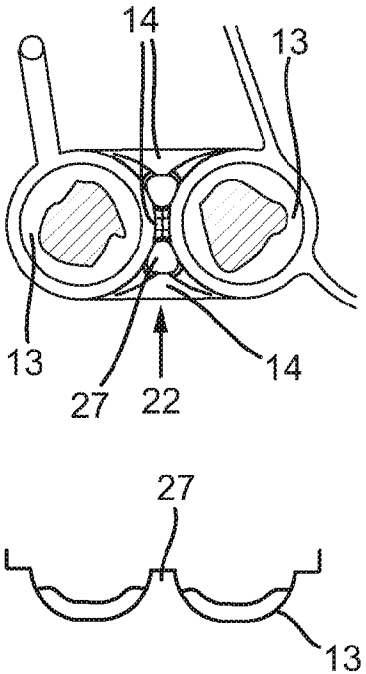
Figure 10A:
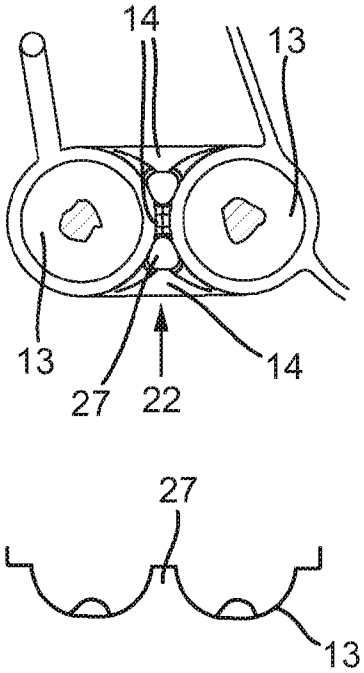

FIG. 10*a* shows that a liquid reagent is introduced into the hemispherical reagent chambers 13*a*, 13*b*. One reagent chamber 13 is used per reagent, which is also referred to as a "pearl" because of its shape. Therefore, a "pearl necklace structure" is provided overall in the mixing chamber 22. The reagent is applied in the middle of the reagent chamber 13*a*, 13*b* in each case. During the following drying procedure, the reagent wets the surroundings of the dosing point and forms a uniform film. Since the reagent chambers are free of edges or corners, in which the reagent could concentrate, very uniform distribution occurs. If the liquid reagent reaches the connection channels 14, it enters therein. However, it is decelerated by the flow resistance of the connection channels 14 and does not flow up to the transition into the adjacent reagent chamber 13. If the liquid reagent reaches the upper boundary of the reagent chamber 13, which forms the termination to the surface of the microfluidic element 1, the reagent stops at the edge and does not flow further. The cross-sectional elevation performed therefore has a capillary stop effect.

The connection channels 14 typically have a cross section such that the liquid is decelerated in the connection channels 14 and is not transported into the adjacent reagent chamber 13 because of capillary forces. On the one hand, the cross section must therefore be sufficiently large that the occurring capillary forces are sufficiently small so that the connection channels are not completely filled with the reagent and the reagents do not mix in the connection channels. On the other hand, the cross section of the connection channels must be sufficiently small that the flow resistance is sufficient to decelerate inflowing reagent in the connection channels 14.

The suitable selection of the cross section of the connection channels 14 does not only influence the drying process if solely capillary forces are active. The cross sections also influence the mixing efficiency and the exchange of liquids between two reagent chambers 13. In order that sufficiently high flow velocities are achieved, which allow a fluid exchange between the chambers 13, the cross section of the connection channels is at least 0.1 $mm^2$, typically 0.4×0.4 $mm^2$ in size. Cross sections of less than 0.05 $mm^2$ have been shown to be unsuitable.

The reagent chambers 13 which are hemispherical or rounded on the base show that drying of the reagents without problems is possible upon filling with a liquid reagent using a volume of at most 70% of the chamber volume. Mixing of two reagents in two adjacent chambers 13 is reliably prevented. The volume of the liquid reagent to be applied is typically less than 60% of the chamber volume, particularly typically less than 55%.

FIG. 10*c* shows the two reagent chambers 13 after the liquid reagent has spread out. The connection channels 14 are each only wetted with liquid at their beginning. The largest part of the respective connection channels 14 is free of liquid, so that mixing of the two reagents is reliably prevented.

It has been shown in the context of the disclosure that the reagent chambers 13 having a rounded base, in particular if they are typically integrated into a mixing chamber 22, are not only particularly suitable for the drying of two different reagents, but rather such reagent chambers 13 may be used in non-rotating microfluidic elements 1. The force required for controlling the liquids and dissolving the reagents is generated by an external force. Alternatively to the centrifugal force or rotational force, pressure forces may be generated, which are induced by an external pump, for example. This force may also be based on a hydrostatic pressure. The statements made for rotating test carriers in the context of this disclosure therefore also apply for non-rotating microfluidic elements. The features described on the basis of FIGS. 2 to 9 may also be used accordingly in non-rotating arrangements and channel structures.

It is noted that terms like "preferably", "commonly", and "typically" are not utilized herein to limit the scope of the claimed subject matter or to imply that certain features are critical, essential, or even important to the structure or function of the embodiments disclosed herein. Rather, these terms are merely intended to highlight alternative or additional features that may or may not be utilized in a particular embodiment of the present disclosure.

It is also noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

It will be apparent to those skilled in the art that various modifications and variations can be made to the embodiments described herein without departing from the spirit and scope of the claimed subject matter. Thus it is intended that the specification cover the modifications and variations of the various embodiments described herein provided such modifications and variations come within the scope of the appended claims and their equivalents.

What is claimed is:

1. A microfluidic element for analyzing a liquid sample comprising a substrate, a channel structure enclosed by the substrate, and a cover layer, wherein the microfluidic element is rotatable around a rotational axis;

the channel structure includes a feed channel having a feed opening, a ventilation channel having a ventilation opening, and at least two reagent chambers;

the reagent chambers are directly connected to one another via two separate connection channels in such a manner that a fluid exchange is possible between the reagent chambers, one of the reagent chambers has an inlet opening, which has a fluid connection to the feed channel, so that a liquid sample can flow into the rotational-axis-distal reagent chamber, which, of the two reagent chambers, is positioned farther away from the rotational axis, and at least one of the reagent chambers contains a reagent, which reacts with the liquid sample that is introduced into such reagent chamber.

2. The microfluidic element according to claim 1, wherein the microfluidic element is a test carrier, through which the rotational axis extends.

3. The microfluidic element according to claim 1, wherein the channel structure is an analysis function channel, which comprises a measuring chamber.

4. The microfluidic element according to claim 1, wherein the rotational-axis-distal reagent chamber has the inlet opening.

5. The microfluidic element according to claim 1, wherein the channel structure comprises a mixing chamber, in which the reagent chambers and the connection channels between the reagent chambers are integrated.

6. The microfluidic element according to claim 5, wherein the mixing chamber has a rotational-axis-proximal inlet opening; and a capillary transport channel is implemented laterally and radially externally on the reagent chambers in the mixing chamber, whose cross section is smaller than the cross section of the connection channels, so that liquid flows through the transport channel from the rotational-axis-proximal inlet opening to the rotational-axis-distal reagent chamber, which is opposite to the inlet opening.

7. The microfluidic element according to claim 5, wherein webs are implemented between two adjacent reagent chambers in the mixing chamber, and wherein the webs, by which the reagent chambers in the mixing chamber are separated, extend perpendicularly to the cover layer.

8. The microfluidic element according to claim 1, wherein the reagent chambers are positioned in series in the radial direction in such a manner that the series of the reagent chambers encloses an angle of at most 80° to the radial direction.

9. The microfluidic element according claim 1, wherein the reagent chambers are essentially hemispherical, the opening surface of the hemisphere being terminated by the cover layer of the microfluidic element.

10. The microfluidic element according to claim 1, wherein the reagent chamber adjacent to the rotational axis has the inlet opening and an air inlet, which connects the reagent chamber to the ventilation channel.

11. The microfluidic element according to claim 1, wherein one of the connection channels between two adjacent reagent chambers is positioned in such a manner that it aligns with the centers of the two reagent chambers.

12. The microfluidic element according to claim 11, wherein the second connection channel is connected laterally to the two reagent chambers in such a manner that it extends outside a central axis connecting the centers of two adjacent reagent chambers.

13. The microfluidic element according to claim 1, wherein the two adjacent reagent chambers are positioned in such a manner that their spacing is less than the smallest dimension of the reagent chambers along a plane which extends perpendicularly to a surface normal of the substrate.

14. The microfluidic element according to claim 1, wherein the reagent chambers are implemented so that filling the rotational-axis-distal reagent chamber with a liquid and dissolving of the reagent contained in the rotational-axis-distal reagent chamber occurs without liquid flowing into the adjacent reagent chamber.

15. The microfluidic element according to claim 1, wherein the connection channels have a cross section, in which the smallest cross-sectional dimension is at least 150 μm.

* * * * *